United States Patent [19]

Jamer

[11] 4,331,248

[45] May 25, 1982

[54] SELF LOCKING CONTAINER CLOSURE

[76] Inventor: Ernst R. Jamer, 625 Shelter Creek La. #353, San Bruno, Calif. 94066

[21] Appl. No.: 182,552

[22] Filed: Aug. 29, 1980

[51] Int. Cl.[3] ..... B65D 41/48

[52] U.S. Cl. ..... 215/256; 215/321

[58] Field of Search ..... 215/253, 256

[56] References Cited

U.S. PATENT DOCUMENTS

| | | | |
|---|---|---|---|
| 2,993,612 | 7/1961 | Trautvetter | 215/256 |
| 3,032,226 | 5/1962 | Terwilliger | 215/256 |
| 3,300,073 | 1/1967 | Benz | 215/256 X |
| 3,338,446 | 8/1967 | Faulstich | 215/256 X |
| 3,462,035 | 8/1969 | Grussen | 215/253 |
| 3,905,502 | 9/1975 | Wassilieff | 215/272 X |
| 4,166,552 | 9/1979 | Faulstich | 215/256 |
| 4,192,428 | 3/1980 | Segmuller | 215/256 |

FOREIGN PATENT DOCUMENTS

| | | | |
|---|---|---|---|
| 1037492 | 7/1966 | United Kingdom | 215/253 |

*Primary Examiner*—Donald F. Norton

*Attorney, Agent, or Firm*—Townsend and Townsend

[57] ABSTRACT

A one-piece container closure having special utility for use with pressurized containers, such as champagne bottles, is disclosed. The closure includes a shank and a top, attached to the upper end of the shank, which combine to seal the bottle. A pleated, resilient skirt depends from the top and surrounds the ring on the neck of the bottle. A plurality of retaining shoulders extend inwardly from the skirt to engage a lower surface on the ring. The retaining shoulders have an upwardly and inwardly inclined surface so that when capping the bottle, the inclined surface rides against the ring on the bottle. A tear strip attached along the lower edge of the skirt inhibits the radial expansion of the lower edge of the skirt. As the retaining shoulders of the cap are forced over the ring, the upper portion of the shoulders pivot outwardly. After clearing the ring, the resilient skirt pivots the shoulders under the ring. To remove the cap from the bottle, the tear strip is torn away. This allows the entire skirt to expand radially and permit the retaining shoulders to become disengaged from under the ring on the bottle when the cap is pulled upwardly.

18 Claims, 2 Drawing Figures

SELF LOCKING CONTAINER CLOSURE

BACKGROUND OF THE INVENTION

Closures for pressurized containers have generally been multicomponent devices. For example, sparkling wines, such as champagne, sekt or spumante have often been sealed with cork closures wired onto the neck of the bottle. These natural cork closures, besides being expensive, require a number of steps for their insertion and additional steps for placing the wire retainer over the cork and around a ring on the neck of the bottle. Such a closure adds to the cost of the product sold.

One problem with closures for sparkling wines which use wire retainers is their well-known propensity to suddenly blow off the end of the bottle after the wire retainer is removed. This may tend to happen especially if the wine is not chilled sufficiently or if it is shaken or jarred; in either case the high pressures developed beneath the cork, be it natural or plastic, are sufficient to discharge the cork from the bottle at quite high velocities. Damage to persons and property often results from the sudden, unexpected discharge of the cork.

In U.S. Pat. No. 3,946,891 to Picoy, et al., a flexible plastic cap for use on pressurized containers which eliminates the wire retainer is disclosed. The cap in Picoy includes an inner shank, an outer cap and a depending skirt portion having internal rib portions for engagement under the ring on the neck of the bottle. However in Picoy the cap relies upon circumferential expansion of the skirt material to permit the rip portion to pass over the outwardly extending ring or band on the bottle. Thus the thickness of the ring around the neck of the bottle and the thickness of the rib portion on the skirt are limited by the resilient character of the material from which the cap is made. If the circumferential stretching is too great, the skirt may be permanently deformed so that the rib portion does not fully engage the lower surface of the rim of the bottle. If the ring and/or ribs are not thick enough, the cap may blow off the bottle. Further, even if the plastic material from which the cap is made would tend to return to its fully unstressed state, because of the time lag involved the cork may be blown off the end of the bottle before such contraction has been completed.

The following patents may also be of interest: U.S. Pat. Nos. 4,162,736; 4,057,160; 4,033,472 and 3,809,370.

SUMMARY OF THE INVENTION

A one-piece container closure finding special utility when used with containers holding pressurized fluids is disclosed. The closure, or cap, includes generally a shank and a top attached to the upper end of the shank. The shank is sized to fit within the neck of the container, typically a bottle adapted for holding sparkling wines, such as champagne. The combination of the top and the shank is of conventional design and acts to seal the interior of the bottle.

A skirt portion depends from the lower outer edge of the top of the cap and surrounds the upper portion of the neck of the bottle. The bottle has a neck ring located below the rim of the bottle. Along the lower edge of the skirt are a plurality of retaining shoulders each having a generally horizontal upper surface for engaging a lower surface on the ring of the bottle.

The retaining shoulders have an upwardly and inwardly tapered inclined surface so that when the cap is placed over the neck of the bottle, the inclined surfaces ride against the ring on the bottle. A tear strip is attached along the lower edge of the skirt to inhibit the radial expansion of the lower edge of the skirt; the lower portion of the retaining shoulders are likewise inhibited from radial expansion by the tear strip. As the retaining shoulders of the cap are forced over the ring on the neck of the bottle, the upper portions of the shoulders pivot radially outwardly. This outward pivotal movement is possible because the skirt has a number of resilient, expandable pleated sections between the retaining shoulders. After the upper, ring engaging surfaces of the retaining shoulders have cleared the ring, the resilient skirt pivots the shoulders back to their normal, generally horizontal attitude so that the ring engaging surfaces of the retaining shoulders engage the lower surface of the ring.

To remove the cap from the bottle, the tear strip is torn away from the lower edge of the skirt. This allows the entire skirt to expand radially and permit the retaining shoulders to disengage from under the ring on the bottle.

The closure of the invention can be molded as a single, unitary piece; the price of the closure can therefore be low. The corking or capping machines which would be required when using the cap would be simple because it is mounted on the container with a single, linear movement.

The heart of this invention lies in the provision of a resilient, expandable skirt. The pivotal movement of the shoulder as it pivots outwardly when the cap is inserted over the neck of a container is not limited by the elasticity of the material. The pleated skirt allows the shoulders to pivot as they ride over the ring on the neck of the bottle. Thus the ring on the neck can be thicker and the upper ring engaging surfaces of the retaining shoulders can be much deeper without causing the elastic limit of the skirt material to be exceeded. Because the ring-shoulder engaging surface can be much deeper, the cap can be secured to the container with the ability to withstand much higher internal pressures within the container.

The resilient skirt also provides an extra degree of safety compared with closures using wire retainers. After the tear strip is pulled away, the resilient skirt and the shoulders continue to keep the cap secured to the container. Only when the cap is grasped by the user and urged upwardly, typically with a simultaneous twisting action, will the retaining forces of the shoulders be overcome to allow the cap to be removed.

The tear strip provides a dual function. It secures the lower edge of the skirt against radial expansion to keep the cap on the container. It also insures against tampering with the contents of the container for the only way to remove the cap is to first remove the tear strip. After removal tampering is obvious.

Additional features and advantages of the invention will appear from the following description in which the preferred embodiment has been set forth in detail in conjunction with the accompanying drawings.

DETAILED DESCRIPTION OF THE PREFERRED EMBODIMENT

Figure 1:
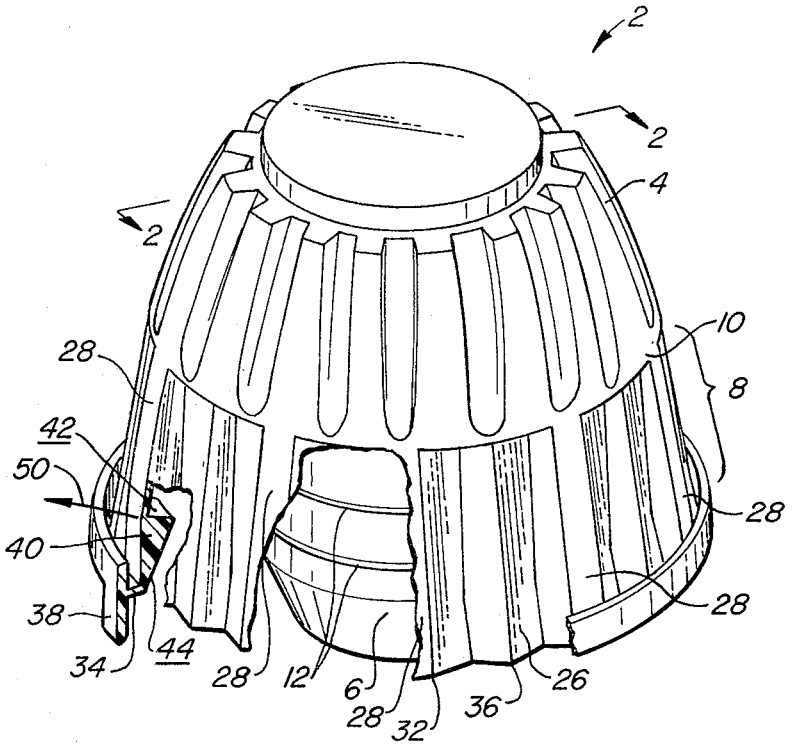
FIG. 1 is an isometric view of the cap of the invention partially broken away to show a retaining shoulder.

Turning now to the figures, generally the cap 2 of the invention includes a top 4, a shank 6 extending centrally from the top and a skirt 8 attached to and depending from the lower outer edge 10 of the top.

Although the preferred embodiment will be described in terms of a cap particularly adapted for use with a bottle containing sparkling wine, the cap of the present invention can also be used for sealing other types of containers of the type having a ring around the neck of the container.

Figure 2:
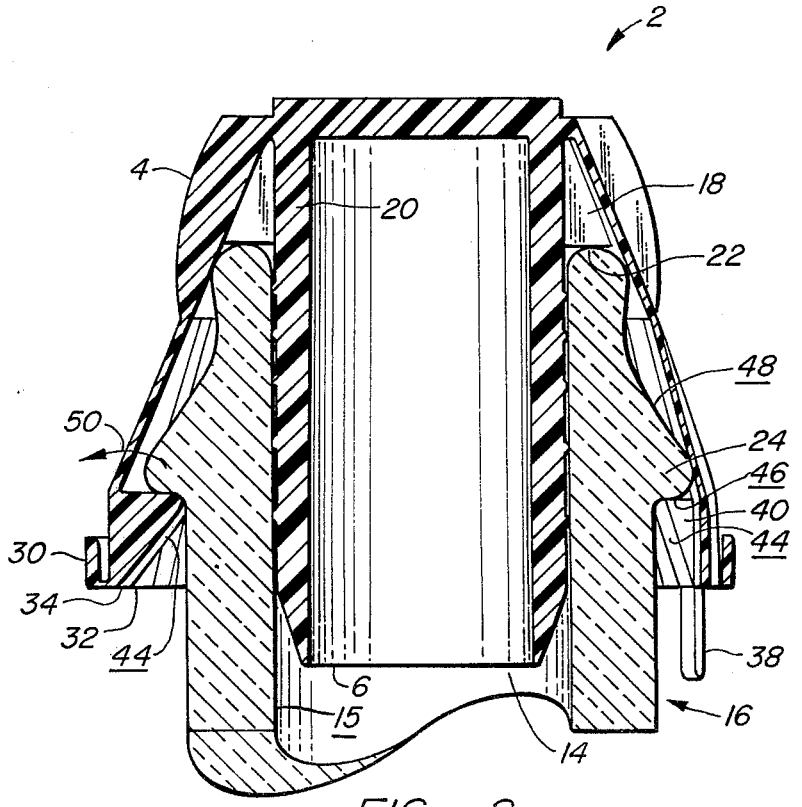
FIG. 2 is a cross-sectional view of the cap mounted to the neck of the bottle.

The top and shank of the cap are of conventional design. The shank includes a number of sealing ridges 12. When the shank is forced within the bore 14 of the neck 16 of the bottle, the sealing ridges are pressed tightly against the interior surface 15 of the bore thus insuring a tight seal. A number of webs 18, shown in FIG. 2, are formed between the top 4 and the upper portion 20 of the shank. When the cap is fully seated over the neck of the bottle, the webs contact the rim 22 of the bottle.

The neck of the bottle has a ring 24 located on its outer surface below the rim.

The skirt has a number of alternating, generally vertically disposed, pleated segments 26 and locking segments 28. The locking segments are generally planar members extending from outer edge 10. The pleated segments are arranged between each locking segment and likewise depend from the lower outer edge of the top. A tear strip 30 is connected to the lower edge 32 of locking segments 28 by a relatively thin connecting segment 34. A handle portion 38 of the tear strip is provided so that the tear strip can be grasped by the user and torn away from the lower edge of the skirt.

A retaining shoulder 40 extends inwardly from near the lower edge of each of the locking segments of the skirt. The retaining shoulders have a triangular cross-sectional shape and include a generally horizontal upper ring engaging surface 42 (see FIG. 1) and a upwardly and inwardly sloping ring biasing surface 44 (see FIG. 2). When the cap is fully inserted over the neck of a bottle, the upper ring engaging surface lies juxtaposed to the generally horizontal lower surface 46 of ring 24 on the neck of the bottle.

The W-shaped cross-sectional outline of pleated segments 26 is shallowest near outer edge 10, is deepest near the ring engaging surface 42 and then narrows somewhat at their lower edges 36. This variation promotes greater flexibility when capping the bottle while somewhat inhibiting radial expansion of the skirt along edges 32, 36 after the tear strip is removed. Therefore, the cap will not be as susceptible to inadvertently blowing off the bottle after the tear strip is removed, a significant safety feature.

To cap the bottle the user simply forces the shank of the cap within the bore of the bottle and presses on the top of the cap until surface 42 of retaining shoulders 40 engage lower surface 46 of ring 24. As the shoulders pass over the ring, the tear strip keeps the lower edges of the skirt from radially expanding. The force exerted by the upper surface 48 of ring 24 against ring bias surface 44 of retaining shoulder 40 causes the retaining shoulders to pivot in the direction indicated by arrow 50. This outward pivotal movement is made possible by the expansion of the skirt along the pleated segments.

To remove the cap the user first grips the handle portion of the tear strip and tears the tear strip away from the lower edge of the skirt. The user then grasps the top and pulls upwardly, typically with a simultaneous twisting action. The unrestrained pleated skirt allows the shoulders to expand radially and become disengaged from the ring.

In the disclosed embodiment the retaining shoulders are mounted at the lower ends of locking segments of the skirt. If desired a number of the pleated segments can be modified so that the retaining shoulders extend from the pleated segments so that the entire skirt is comprised of pleated segments. Depending upon various factors such as the materials chosen for the cap, the size of the ring on the neck of the bottle and the pressure within the bottle, a greater or fewer number of pleated segments and retaining shoulders can be used. Also other types of radially expandable skirts can be used in lieu of the pleated skirt.

The invention can also be used with containers which are not pressurized, although other methods for sealing the bore of the container may be necessary. When used with low-pressure or non-pressurized containers, the shank may be shortened or eliminated. When sealing sparkling wine, a cork insert may be used in addition to, or in lieu of, the shank so that the wine may pick up its subtle nuances during aging. Ring 24 may also have other cross-sectional shapes, such as rectangular rather than triangular, if so desired. Other modification and variation may be made to the present embodiment without departing from what is regarded as the invention.

What is claimed is:

1. A container closure for use on a container of the type having a hollow neck, a rim at the end of the neck, the rim circumscribing the mouth of the container, and a ring extending around the neck, the closure comprising:

a top portion adapted to seat against said rim to seal said container;

a skirt depending from said top portion to surround a portion of said neck, said skirt having an upper edge attached to said top portion, a lower edge opposite said top edge, said lower edge adapted to extend past said ring, and a plurality of resilient radially expandable segments;

said skirt having a plurality of inwardly directed shoulder portions, said shoulder portions having means for rotationally biasing said shoulder portions away from the ring as said shoulder portions pass the ring on the container, said shoulder portions also including a ring engagement surface adapted for engagement under said ring to secure said closure on said container; and means, surrounding said shoulder portions and removably attached to said skirt at the lower edge, for restricting the radial movement of said shoulder portions.

2. The closure of claim 1 wherein said removable restricting means includes a tear strip attached to the lower edge of said skirt.

3. The closure of claim 2 wherein said tear strip is attached to a portion of the lower edges of said expandable segments of said skirt.

4. The container closure of claim 1 wherein said top portion includes a shank portion configured for insertion through the mouth into the hollow neck of the container.

5. The container closure of claim 1 wherein said skirt includes a plurality of generally planar locking segments and wherein said shoulder portions extend from said locking segments.

6. The closure of claim 5 wherein said locking and expandable segments alternate.

7. The closure of claim 1 wherein said rotational biasing means includes an upwardly and inwardly angled shoulder biasing surface so that as said shoulder portions are urged past the ring on the neck of the container, the shoulder portions are pivoted outwardly under the partial restraint of said expandable segments and are pivoted inwardly after said shoulder portions have cleared the ring.

8. The closure of claim 1 wherein said ring engagement surfaces are generally horizontal.

9. The closure of claim 1 wherein said expandable segments are pleated.

10. An improved bottle closure, particularly suited for sealing pressurized bottles, said bottle having a ring around the upper portion of the neck of the bottle, said closure of the type including a top portion adapted to seat against the rim of the bottle and seal said bottle, a skirt extending from said top portion to surround the upper portion of the neck of the bottle, means for engaging a lower surface of the ring, the improvement comprising:

said skirt is a resilient, radially expandable skirt having a plurality of pleated segments so that said ring surface engaging means move outwardly as said engaging means are forced past the ring on the neck of the bottle during insertion of said closure on said bottle; and removable means for limiting the radial movement of said ring surface engaging means so that said closure is retained on said bottle.

11. The bottle closure of claim 10 further comprising:

a plurality of locking segments alternating with said pleated segments; and said ring surface engaging means extend from a plurality of said locking segments.

12. An article of manufacture comprising:

a hollow container, said container having a hollow neck bounded at its mouth by a rim, said neck having a ring on the external surface of said neck and located below the rim;

a one-piece closure including means for sealing said container mouth;

said closure further comprising a retaining portion, said retaining portion including:

a resilient expandable skirt depending from said sealing means to surround said ring on said neck;

a plurality of inwardly projecting shoulder portions extending from the inside surface of said skirt and adapted to engage a lower surface of said ring, said shoulder portions including surface means for pivoting said shoulder portions outwardly thereby expanding said expandable skirt as said closure is urged over the neck of said bottle to allow said surface pivoting means to engage said ring; and means, removably attached to the lower edge of said skirt, for restraining radial movement of said shoulder portions.

13. The article of manufacture of claim 12 wherein said container is a bottle adapted to hold sparkling wine.

14. The article of manufacture of claim 12 wherein said sealing means includes a shank sized to fit within said hollow neck.

15. A container closure for use on a container of the type having a hollow neck, a rim at the end of the neck, the rim circumscribing the mouth of the container, and a ring extending around the neck, the closure comprising:

a top portion adapted to seat against said rim to seal said container;

a skirt depending from said top portion to surround a portion of said neck, said skirt having an upper edge attached to said top portion, a lower edge opposite said top edge, said lower edge adapted to extend past said ring, and a plurality of resilient radially expandable segments;

said skirt having a plurality of inwardly directed shoulder portions, said shoulder portions having means for rotationally biasing said shoulder portions away from the ring as said shoulder portions pass the ring on the container, said shoulder portions also including a ring engagement surface adapted for engagement under said ring to secure said closure on said container; and a tear strip attached to a portion of the lower edges of said expandable segments of said skirt to restrict the radial movement of said shoulder portions.

16. A container closure for use on a container of the type having a hollow neck, a rim at the end of the neck, the rim circumscribing the mouth of the container, and a ring extending around the neck, the closure comprising:

a top portion adapted to seat against said rim to seal said container;

a skirt depending from said top portion to surround a portion of said neck, said skirt having an upper edge attached to said top portion, a lower edge opposite said top edge, said lower edge extending past said ring, and a plurality of resilient radially expandable pleated segments;

said skirt having a plurality of inwardly directed shoulder portions, said shoulder portions having means for rotationally biasing said shoulder portions away from the ring as said shoulder portions pass the ring on the container, said shoulder portions also including a ring engagement surface adapted for engagement under said ring to secure said closure on said container; and removable means for restricting the radial movement of said shoulder portions.

17. An article of manufacture comprising:

a hollow container, said container having a hollow neck bounded at its mouth by a rim, said neck having a ring on the external surface of said neck and located below the rim;

a closure including means for sealing said container mouth;

said closure further comprising a retaining portion, said retaining portion including:

a resilient expandable skirt, including alternating pleated and planar portions, depending from said sealing means to surround said ring on said neck;

a plurality of inwardly projecting shoulder portions extending from the inside surface of said skirt and adapted to engage a lower surface of said ring; and removable means for restraining radial movement of said shoulder portions.

18. An article of manufacture comprising:

a hollow container, said container having a hollow neck bounded at its mouth by a rim, said neck having a ring on the external surface of said neck and located below the rim;

a one-piece closure including means for sealing said container mouth;

said closure further comprising a retaining portion, said retaining portion including:

a resilient expandable skirt depending from said sealing means to surround said ring on said neck and including alternating pleated portions and planar portions;

a plurality of inwardly projecting shoulder portions extending from the inside surface of said skirt and adapted to engage a lower surface of said ring; and means, removably attached to the lower edge of said skirt for restraining radial movement of said shoulder portions.

* * * * *